US009458586B2

(12) United States Patent
Masters et al.

(10) Patent No.: US 9,458,586 B2
(45) **Date of Patent: *Oct. 4, 2016**

(54) APPARATUS AND METHOD FOR SECURING A FAIRING TO A MARINE ELEMENT

(71) Applicant: VIV Suppression, Inc., Houston, TX (US)

(72) Inventors: Rodney H. Masters, Houston, TX (US); Billy L. Griffith, Spring, TX (US)

(73) Assignee: ASSET INTEGRITY MANAGEMENT SOLUTIONS, L.L.C., Houston, TX (US)

( * ) Notice: Subject to any disclaimer, the term of this patent is extended or adjusted under 35 U.S.C. 154(b) by 26 days.

This patent is subject to a terminal disclaimer.

(21) Appl. No.: 14/486,976

(22) Filed: Sep. 15, 2014

(65) Prior Publication Data

US 2015/0003917 A1 Jan. 1, 2015

Related U.S. Application Data

(63) Continuation of application No. 13/514,468, filed as application No. PCT/US2010/059503 on Dec. 8, 2010, now Pat. No. 8,834,070.

(60) Provisional application No. 61/267,788, filed on Dec. 8, 2009.

(51) Int. Cl.
*E02B 1/00* (2006.01)
*B63B 21/66* (2006.01)

(52) U.S. Cl.
CPC ..... *E02B 1/00* (2013.01); *B63B 21/663* (2013.01); *Y10T 29/49826* (2015.01)

(58) Field of Classification Search
CPC ..... F16B 2/02; F16B 2/20; F16B 7/22
See application file for complete search history.

(56) References Cited

U.S. PATENT DOCUMENTS

| | | | | |
|---|---|---|---|---|
| 3,241,513 | A * | 3/1966 | Rather et al. | 114/243 |
| 4,171,674 | A * | 10/1979 | Hale | 114/243 |
| 4,474,129 | A | 10/1984 | Watkins et al. | |
| 5,456,199 | A | 10/1995 | Kernkamp | |
| 5,678,504 | A * | 10/1997 | Toplosky et al. | 114/243 |
| 6,010,278 | A | 1/2000 | Denison et al. | |
| 6,019,549 | A | 2/2000 | Blair et al. | |
| 6,048,136 | A | 4/2000 | Denison et al. | |
| 6,179,524 | B1 | 1/2001 | Allen et al. | |
| 6,401,646 | B1 | 6/2002 | Masters et al. | |
| 6,702,026 | B2 * | 3/2004 | Allen et al. | 166/367 |
| 6,845,644 | B1 | 1/2005 | Buckner | |
| 7,337,742 | B1 | 3/2008 | Masters et al. | |
| 8,523,492 | B2 | 9/2013 | Baugh | |
| 2005/0254903 | A1 | 11/2005 | McMillan et al. | |
| 2008/0050181 | A1 | 2/2008 | Masters et al. | |
| 2009/0185867 | A1 | 7/2009 | Masters et al. | |
| 2009/0252558 | A1 | 10/2009 | Masters et al. | |

FOREIGN PATENT DOCUMENTS

| | | | |
|---|---|---|---|
| GB | 2402266 | A | 12/2004 |

* cited by examiner

*Primary Examiner* — Benjamin Fiorello
(74) *Attorney, Agent, or Firm* — Edmonds & Nolte, P.C.

(57) ABSTRACT

Apparatus and methods for securing a fairing around a marine element. The apparatus can include first and second opposing sides, and a third side extending between the first and second sides. An attachment mechanism can extend from the third side, and is configured to interlock with a corresponding attachment mechanism of an opposing connector to secure the fairing around a marine element.

22 Claims, 6 Drawing Sheets

APPARATUS AND METHOD FOR SECURING A FAIRING TO A MARINE ELEMENT

CROSS-REFERENCE TO RELATED APPLICATIONS

This application is a continuation of U.S. patent application having Ser. No. 13/514,468, filed on Jun. 7, 2012, which claims the benefit of U.S. Provisional Patent Application having Ser. No. 61/267,788, filed on Dec. 8, 2009, both of which are incorporated by reference herein.

BACKGROUND

1. Field of the Invention

Embodiments described generally relate to reducing vortex induced vibrations. More particularly, embodiments described relate to apparatus and methods for reducing vortex induced vibrations on submerged marine elements.

2. Description of the Related Art

Marine elements, such as submerged pipelines, risers, tendons, and other structural components, are subject to vibrations caused by the periodic shedding of eddies resulting from fluid flow. These vibrations place stress on the submerged structures and reduce their fatigue lives. To reduce the effects of the vortex induced vibrations, vortex induced vibration inhibitors (VIVIs), such as fairings and strakes, are often placed on vibration sensitive marine elements. Fairings are generally more efficient in reducing drag and vortex induced vibrations. However, fairings can be difficult to secure on existing marine elements, especially underwater.

There is a need, therefore, for a new apparatus and method for securing fairings on submerged marine elements.

SUMMARY OF THE INVENTION

Apparatus and methods for securing fairings on submerged marine elements are provided. In at least one specific embodiment, the apparatus includes first and second opposing sides, a third side extending between the first and second sides, and an attachment mechanism extending from the third side. The apparatus can be configured to mount on a bearing block of a fairing, and the attachment mechanism can be configured to interlock with a corresponding attachment mechanism of an opposing connector to secure the fairing around the marine element.

In at least one specific embodiment of the method, a fairing can be placed around a marine element, and a first connector can be interlocked with a second connector to secure the fairing around the marine element, wherein the first connector is mounted on a first bearing block on a first inner side of the fairing and the second connector is mounted on a second bearing block on a second inner side of the fairing. The first and second connectors can each comprise first and second opposing sides; a third side extending between the first and second sides; and an attachment mechanism extending from the third side.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with publicly available information and technology.

Figure 2:
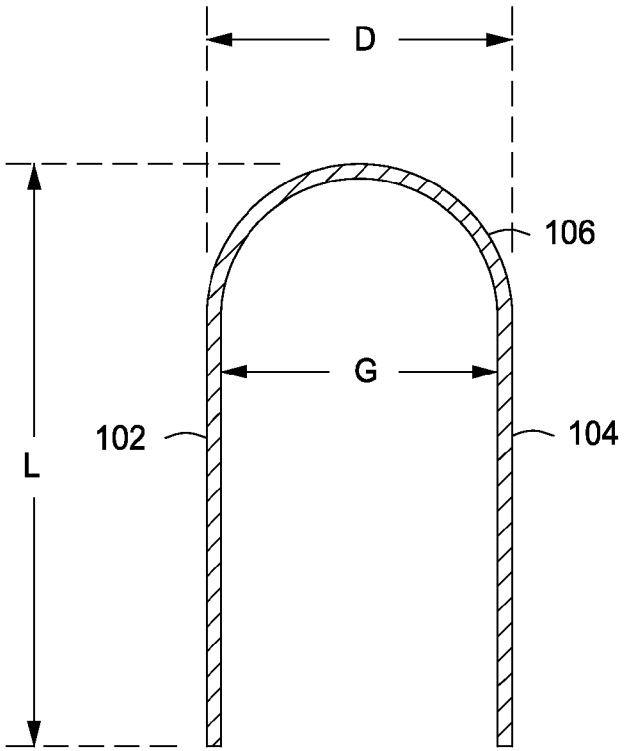
FIG. 2 depicts a top view of the fairing depicted in FIG. 1.
Figure 1:
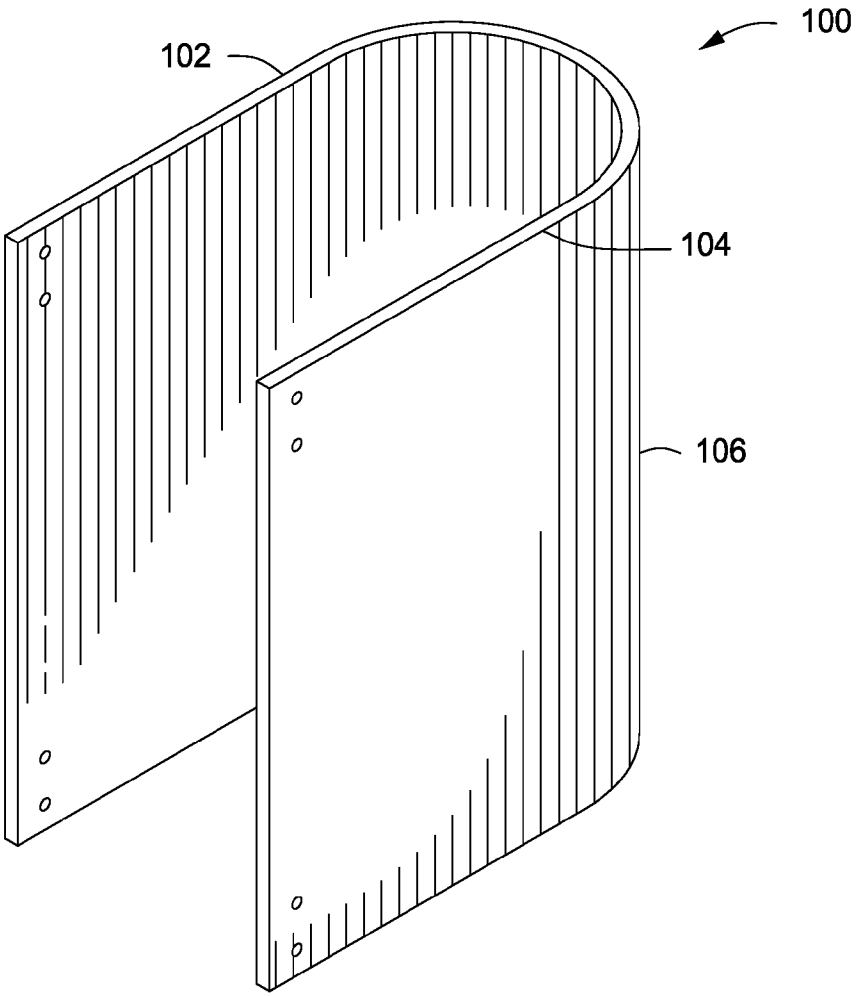
FIG. 1 depicts a perspective view of an illustrative fairing, according to one or more embodiments described.

Referring to FIGS. 1 and 2, the fairing 100 can include a U-shaped shell 106 having spaced apart and opposing sides 102, 104 that define a longitudinal gap G therebetween. The longitudinal gap G allows the shell 106 to be placed around a marine element (not shown), including but not limited to pipes, pipelines, risers, and tendons. The sides 102, 104 can be generally parallel to each other and extend longitudinally to any desired length. In one or more embodiments, the length of the sides 102, 104 can be less than the nominal outer diameter of the shell 106. For example, the fairing 100 can have a length (L) to diameter (D) ratio (aspect ratio or L:D), as depicted in FIG. 2, in the range of 1.50 to 2.50; or 1.75 to 2.0.

The fairing 100 can be constructed from any non-metallic, low corrosive material such as high or low density polyethylene, polyurethane, vinyl ester resin, poly vinyl chloride (PVC), or other materials with substantially similar flexibility and durability properties. These materials provide the fairing 100 with the flexibility be placed around the marine element during installation and the strength to stay on the marine element after installation. The use of such materials substantially eliminates the possibility of corrosion, which can cause the fairing 100 to seize up around the marine element it surrounds.

Figure 3:
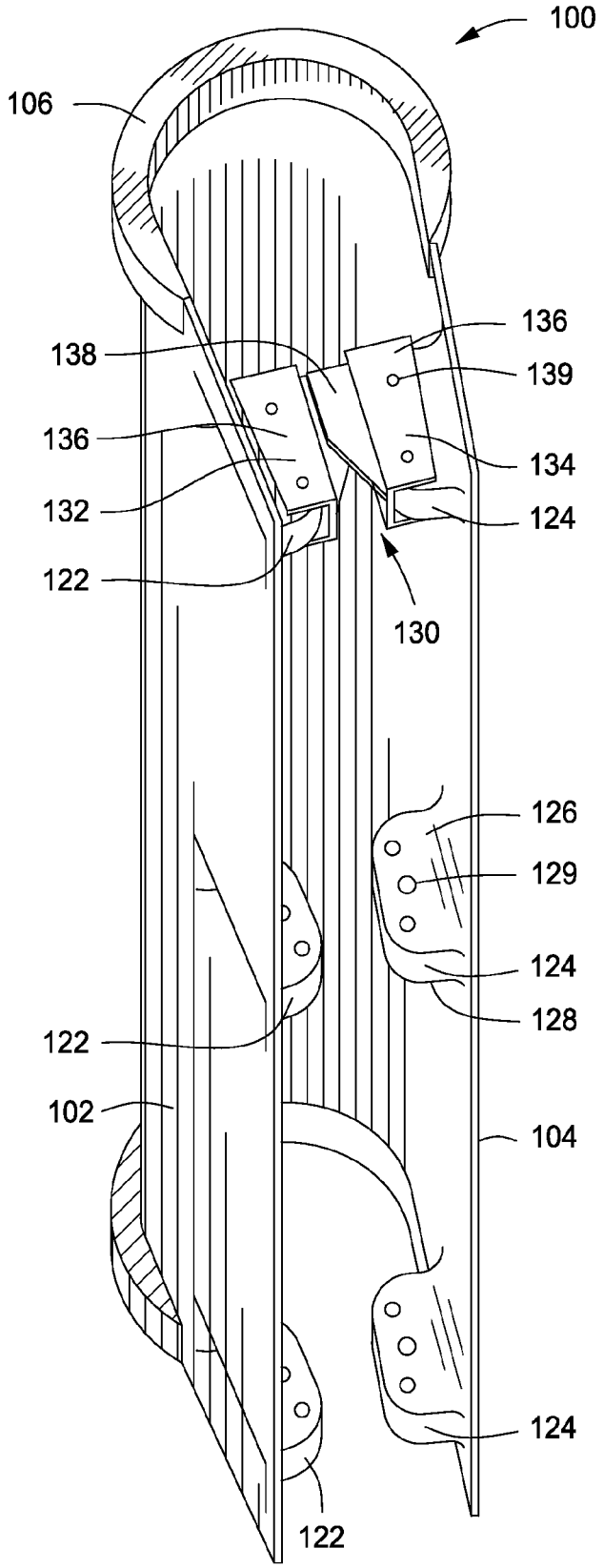
FIG. 3 depicts a perspective view of an illustrative fairing having a connector assembly, according to one or more embodiments described.
Figure 4:
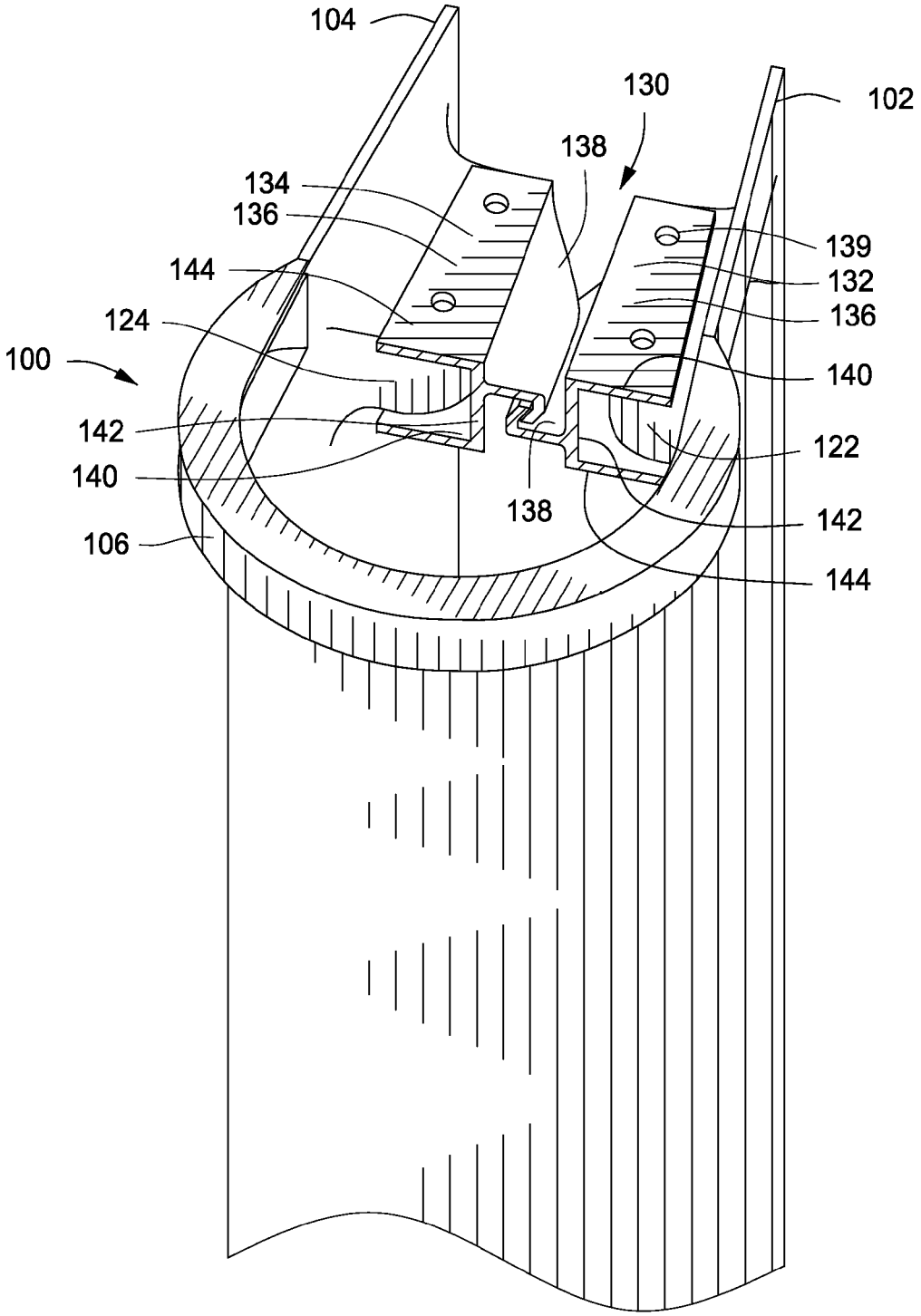
FIG. 4 depicts an enlarged perspective view of the fairing and connector assembly depicted in FIG. 3.

Referring to FIGS. 3 and 4, the fairing 100 can include one or more pairs of opposing bearing blocks 122, 124 (three pairs are shown). One or more first bearing blocks 122 can be located on an inner surface of the first side 102 of the fairing 100, and one or more second bearing blocks 124 can be located on an inner surface of the second side 104 of the fairing 100, generally opposite the first bearing blocks 122. Each bearing block 122, 124 can include an upper surface 126 and a lower surface 128. One or more bearing block apertures 129 (three are shown) can extend through each bearing block 122, 124 from the upper surface 126 to the lower surface 128. The bearing block apertures 129 can be used to secure the connector assembly 130 to the bearing blocks 122, 124, as described in more detail below.

A connector assembly 130 including first and second connectors 132, 134 can be used to secure the fairing 100 in place around the marine element. Each connector 132, 134 can include a generally U-shaped body 136 having first and second opposing sides 140, 144 and a third side 142 extending between the first and second sides 140, 144. The body 136 of each connector 132, 134 can be configured to mount on a bearing block 122, 124. Each side 140, 144 can include one or more connector apertures 139 (two are shown) formed therethrough. When a connector 132, 134 is mounted on a bearing block 122, 124, the connector apertures 139 in the first and second sides 140, 144 can be aligned with a corresponding bearing block aperture 129 such that a securing device (not shown) can be inserted therethrough to secure the connector 132, 134 to the bearing block 122, 124. The securing device can be a pin, screw, bolt, or any other device suitable to secure the connector 132, 134 to the bearing block 122, 124.

Figure 6:
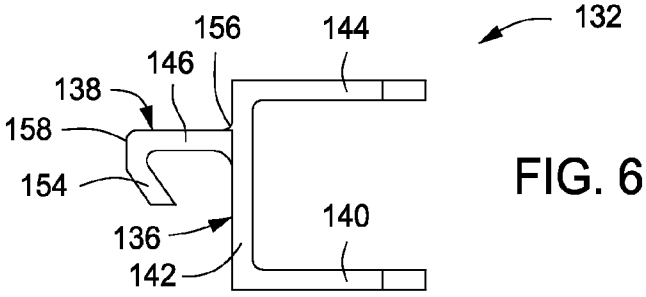
FIG. 6 depicts a top view of the connector depicted in FIGS. 3 and 4, according to one or more embodiments described.
Figure 7:
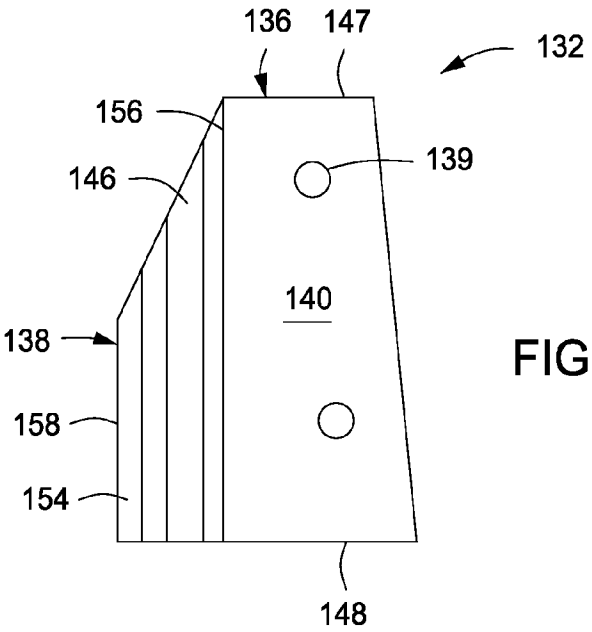
FIG. 7 depicts a side view of the illustrative connector depicted in FIGS. 3 and 4, according to one or more embodiments described.
Figure 5:
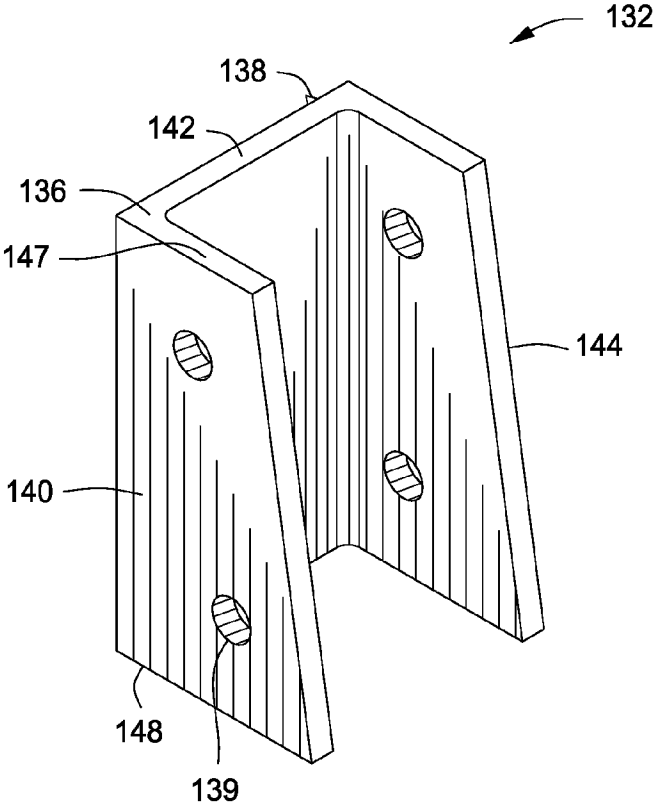
FIG. 5 depicts a perspective view of the connector depicted in FIGS. 3 and 4, according to one or more embodiments described.

Referring to FIGS. 5, 6, and 7, the sides 140, 144 can be spaced apart and shaped such that each side 140, 144 can contact a corresponding surface 126, 128 of the bearing block 122, 124. The width of the sides 140, 144 can be tapered from a first end 148 to a second end 147 thereof. Although the material of the connector 132 can vary to according to its intended use, the connector 132 is preferably constructed of polyurethane, polyethylene, or fiberglass.

One or more attachment mechanisms 138 can extend from the third side 142 of each connector 132, 134. The attachment mechanisms 138 on opposing connectors 132, 134 can be configured to interlock and/or engage to secure the fairing 100 in place around the marine element. For example, each attachment mechanism 138 can include a first portion 146 and a second portion 154. The first portion 146 can extend from a first end 156, disposed proximate the third side 142 of the body 136, to a second end 158, disposed proximate the second portion 154. The length of the first portion 146 can be tapered from the first end 156 to the second end 158. The first portion 146 can be centrally located along the third side 142, between the first side 140 and the second side 144. Alternatively, the first portion 146 can located along the third side closer to one side 140, 144 than the other 140, 144, i.e. off-center.

The second portion 154 can be oriented at an angle with respect to the first portion 146 to form a hook. The angle between the first portion 146 and the second portion 154 can range from a low of about 30°, about 40°, or about 50° to a high of about 60°, about 70°, or about 80°. Preferably, the angle is about 55°. In one or more embodiments, each connector 132, 134 can be a single, rigid component including the body 136 and the attachment mechanism 138.

Figure 9:
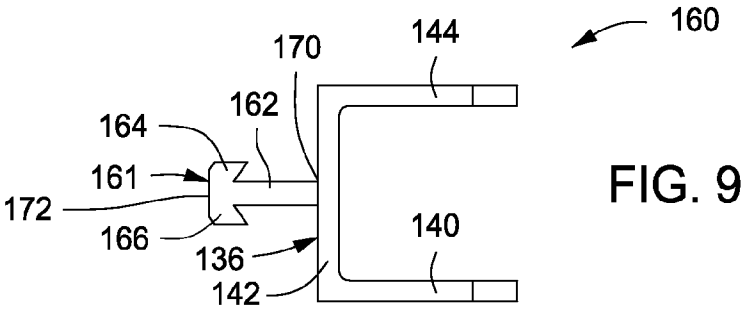
FIG. 9 depicts a top view of the connector depicted in FIG. 8, according to one or more embodiments described.
Figure 10:
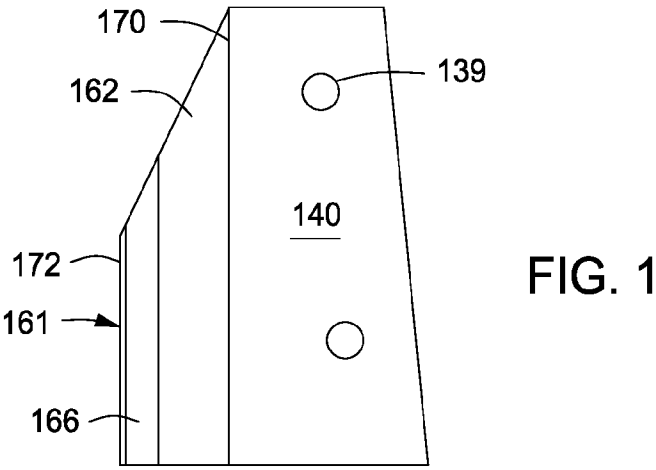
FIG. 10 depicts a side view of the connector depicted in FIG. 8, according to one or more embodiments described.
Figure 8:
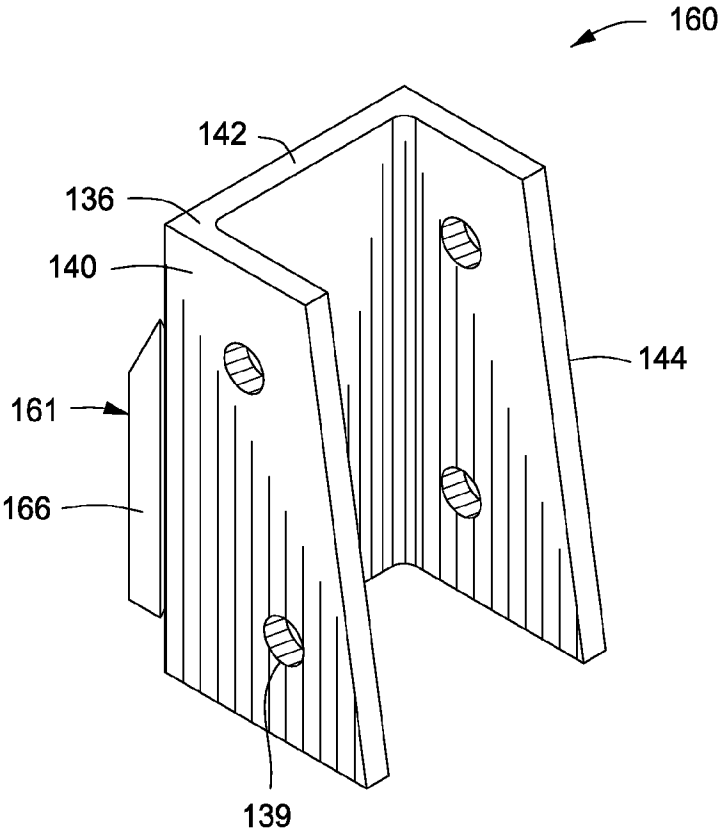
FIG. 8 depicts a perspective view of another illustrative connector, according to one or more embodiments described.

Referring to FIGS. 8-10, another illustrative connector 160 is depicted. The connector 160 can have an attachment mechanism 161 different from the attachment mechanism 138 of the connector 132 depicted in FIGS. 3-7. The attachment mechanism 161 of connector 160 can include a first portion 162, a second portion 164, and a third portion 166. The first portion 162 can extend from a first end 170, disposed proximate the third side 142 of the body 136, to a second end 172, disposed proximate the second and third portions 162, 164. In one or more embodiments, the length of the first portion 162 can be tapered from the first end 170 to the second end 172. In one or more embodiments, the first portion 162 can be positioned generally equidistant between the first and second sides 140, 144.

The second portion 164 can extend from the second end 172 of the first portion 162 at a first angle with respect to the first portion 162, and the third portion 166 can extend from the second end 172 of the first portion 162 at a second angle with respect the first portion 162 such that the second and third portions 164, 166 oppose one another and form a generally T-shaped hook. In one or more embodiments, the first and second angles can be the same. In one or more embodiments, the angle between the first portion 162 and the second and/or third portion 164, 166 can range from a low of about 20°, about 30°, or about 40° to a high of about 60°, about 70°, or about 80°. Preferably, the angle is about 50°.

Figure 12:
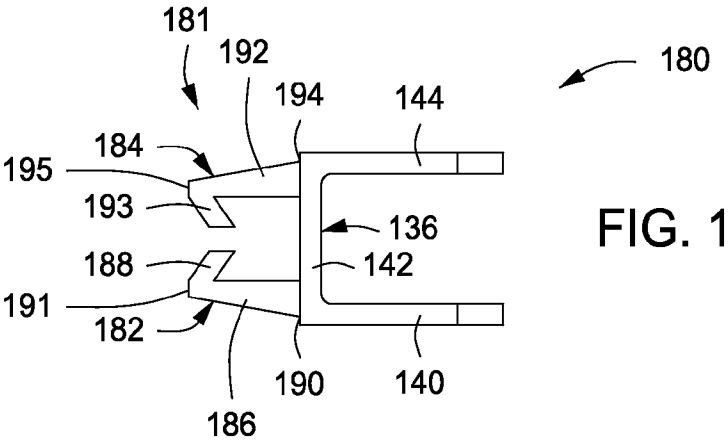
FIG. 12 depicts a top view of the connector depicted in FIG. 11, according to one or more embodiments described.
Figure 13:
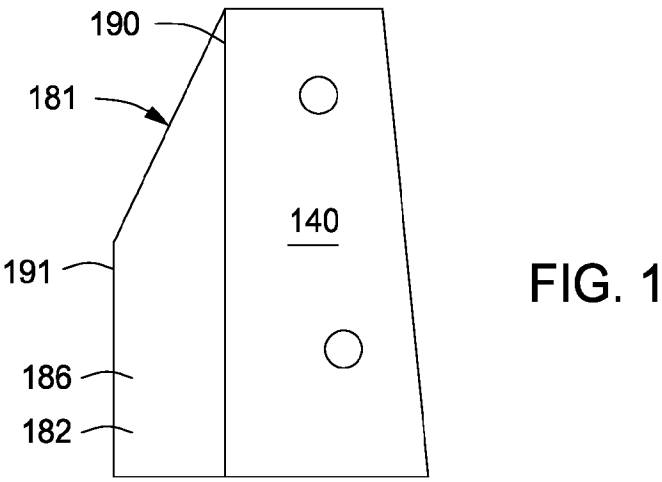
FIG. 13 depicts a side view of the connector depicted in FIG. 11, according to one or more embodiments described.
Figure 11:
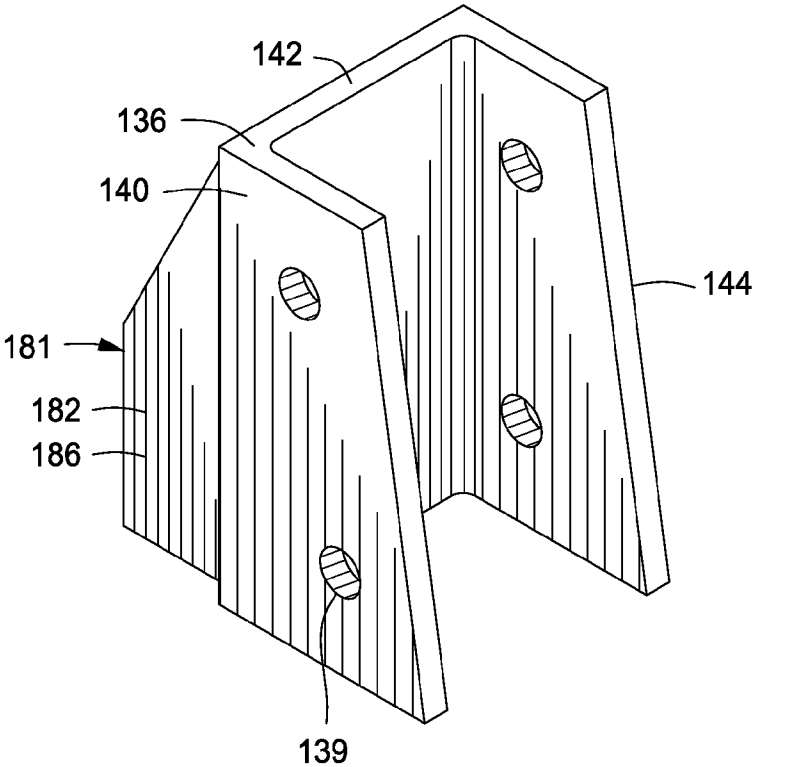
FIG. 11 depicts a perspective view of another illustrative connector, according to one or more embodiments described.

Referring to FIGS. 11-13, another illustrative connector 180 is depicted. The connector 180 can include an attachment mechanism 181 configured to receive the attachment mechanism 161 of the connector 160. The attachment mechanism 181 can include a first 182 receiver and a second receiver 184. The first receiver 182 can include a first portion 186 and a second portion 188. The first portion 186 can extend from a first end 190, disposed proximate the third side 142 of the body 136, to a second end 191, disposed proximate the second portion 188. The second receiver 184 can include a third portion 192 and a fourth portion 193. The third portion 192 can extend from a first end 194, disposed proximate the third side 142 of the body 136, to a second end 195, disposed proximate the fourth portion 193.

The length of the first portion 186 can be tapered from the first end 190 to the second end 191, and the length of the third portion 192 can be tapered from the first end 194 to the second end 195. In one or more embodiments, the first portion 186 can be positioned closer to the first side 140 than the second side 144, and the third portion 192 can be positioned closer to the second side 144 than the first side 140, or vice versa.

The second portion 188 can extend from the second end 191 of the first portion 186 at a first angle with respect to the first portion 186 such that the first and second portions 186, 188 together form a first hook. The fourth portion 193 can extend from the second end 195 of the third portion 192 at a second angle with respect to the third portion 192 such that the third and fourth portions 192, 193 together form a second hook. In one or more embodiments, the first and second hooks can face one another and be configured to interlock with the generally T-shaped hook of the attachment mechanism 161 of the connector 160 (see FIGS. 8-10). The first and second angles can be the same or different. The first angle between the first and second portions 186, 188 and/or the second angle between the third and fourth portions 192, 193 can range from a low of about 20°, about 30°, or about 40° to a high of about 60°, about 70°, or about 80°. Preferably, the angle is about 50°.

The fairing 100 can be placed around a marine element, and the first and second connectors 132, 134, 160, 180 can be interlocked to secure the fairing 100 around the marine element. The first connector 132, 160 can be mounted on the first bearing block 122 on an inner surface of the first side 102 of the fairing 100, and the second connector 134, 180 can be mounted on the second bearing block 124 on an inner surface of the second side 104 of the fairing 100. In one or more embodiments, a remotely operated vehicle (ROV) (not shown) can transport the fairing 100 toward the marine element, and the ROV can place the fairing 100 around the marine element.

In one or more embodiments, the first and second connectors 132, 134, 160, 180 can be secured to the first and second bearing blocks 122, 124 before the fairing 100 is submerged. Once the ROV engages the fairing 100, the ROV can transport the fairing 100 to a marine element. The ROV can then place the marine element between the first 102 and second 104 sides of the fairing 100. The ROV can then press the fairing 100 onto the marine element. As the fairing 100 is pressed onto the marine element, the attachment mechanism 138, 161 of the first connector 132, 160 can slidingly disengage the attachment mechanism 138, 181 of the second connector 134, 180. Once the fairing 100 is disposed around the marine element, the attachment mechanism 138, 161 of the first connector 132 can slidingly re-engage the attachment mechanism 138, 181 of the second connector 134 to secure the fairing 100 around the marine element.

After the fairing 100 has been placed around the marine element, the first and second connectors 132, 134, 160, 180 can be secured to the first and second bearing blocks 122, 124. The ROV can mount the first connector 132 onto the first bearing block 122, aligning the connector apertures 139 and the bearing block apertures 129. The ROV can then secure the first connector 132, 160 to the first bearing block 122 by inserting the securing device into the aligned apertures 129, 139. After the ROV has secured the first connector 132 to the first bearing block 122, the ROV can then slide the second connector 134, 180 onto the second bearing block 124, aligning the connector apertures 139 and bearing block apertures 129. As the second connector 134, 180 is slid into place, the attachment mechanism 138, 161 of the first connector 132, 160 can slidingly engage the attachment mechanism 138, 181 of the second connector 134, 180, interlocking the first and second connectors 132, 134, 160, 180. The ROV can then secure the second connector 134, 180 to the second bearing block 124 by inserting a securing device into each of the aligned apertures 129, 139.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A fairing, comprising:

a shell having first and second opposing shell sides;

a first connector on an inner surface of the first shell side; and a second connector on an inner surface of the second shell side, wherein each of the first connector and the second connector comprises:

a body having first and second opposing sides;

a third side extending between the first and second opposing sides; and at least one hook-shaped attachment mechanism extending from the third side, wherein the at least one hook-shaped attachment mechanism of the first connector is configured to interlock with the at least one hook-shaped attachment mechanism of the second connector to secure the first and second opposing shell sides together such that the inner surface of the first shell side of the fairing is not in contact with the inner surface of the second shell side of the fairing.

2. The fairing of claim 1, wherein the first connector comprises a first portion and a second portion, wherein the first portion extends from the body of the first connector, and wherein the second portion extends from the first portion at an angle of about 30° to about 70°.

3. The fairing of claim 1, wherein the first connector and the second connector are configured to secure the fairing around a marine element, and wherein the marine element comprises a pipe, a pipeline, a riser, or a tendon.

4. The fairing of claim 1, wherein the fairing is constructed from high density polyethylene, low density polyethylene, polyurethane, vinyl ester resin, or poly vinyl chloride (PVC).

5. The fairing of claim 1, wherein the shell is constructed of a single piece of a flexible material.

6. The fairing of claim 1, wherein the first connector has at least two hook-shaped attachment mechanisms extending therefrom.

7. The fairing of claim 1, wherein the second connector has at least two hook-shaped attachment mechanisms extending therefrom.

8. The fairing of claim 1, wherein the hook-shaped attachment mechanism extending from the first connector is configured to interlock with hook-shaped attachment mechanism extending from the second connector such that the first shell side of the fairing is tapered toward the second shell side of the fairing.

9. The fairing of claim 1, wherein the hook-shaped attachment mechanism of the first connector extends toward the inner surface of the second shell side of the fairing.

10. The fairing of claim 1, wherein the hook-shaped attachment mechanism comprises a generally planar portion that extends in a generally perpendicular direction from the third side.

11. The fairing of claim 1, wherein the first and second opposing shell sides taper toward one another when the first and second opposing shell sides are secured together.

12. A fairing, comprising:

a shell having first and second opposing shell sides;

a first connector on an inner surface of the first shell side; and a second connector on an inner surface of the second shell side, wherein each of the first connector and the second connector comprises:

a body having first and second opposing sides;

a third side extending between the first and second opposing sides; and at least one hook-shaped attachment mechanism extending from the third side, wherein the at least one hook-shaped attachment mechanism of the first connector is configured to interlock with the at least one hook-shaped attachment mechanism of the second connector to secure the first and second opposing shell sides together, wherein the first shell side of the fairing is tapered toward the second shell side of the fairing, and wherein the hook-shaped attachment mechanism of the first connector extends toward the inner surface of the second shell side of the fairing.

13. The fairing of claim 12, wherein the hook-shaped attachment mechanism comprises a first portion and a second portion, and wherein the second portion extends from the first portion at an angle of about 30° to about 80°.

14. The fairing of claim 12, wherein the hook-shaped attachment mechanism comprises a first portion and a second portion, and wherein the second portion extends from the first portion at an angle of about 40° to about 60°.

15. The fairing of claim 12, wherein the hook-shaped attachment mechanism of the first connector comprises a generally T-shaped hook.

16. The fairing of claim 15, wherein the second connector comprises at least two hook-shaped attachment mechanisms.

17. The fairing of claim 12, wherein the first connector and the second connector are configured to secure the fairing around a marine element, and wherein the fairing is configured to reduce vibration of the marine element.

18. A method for securing a fairing, comprising:

placing a fairing about a marine element, the fairing comprising:

a shell having first and second opposing shell sides;

a first connector on an inner surface of the first shell side; and a second connector on an inner surface of the second shell side, wherein each of the first connector and the second connector comprises:

a body having first and second opposing sides;

a third side extending between the first and second opposing sides; and at least one hook-shaped attachment mechanism extending from the third side, wherein the at least one hook-shaped attachment mechanism of the first connector is configured to interlock with the at least one hook-shaped attachment mechanism of the second connector to secure the first and second opposing shell sides together; and interlocking the hook-shaped attachment mechanism of the first connector with the hook-shaped attachment mechanism of the second connector to secure the fairing about the marine element, wherein the first and second connectors are interlocked such that the inner surface of the first shell side of the fairing does not touch the inner surface of the second shell side of the fairing.

19. The method of claim 18, wherein the fairing is placed about the marine element such that the first connector opposes the second connector prior to interlocking the first and second connectors.

20. The method of claim 18, wherein the first and second connectors are interlocked with a remotely operated vehicle.

21. The method of claim 18, wherein the hook-shaped attachment mechanism comprises a generally planar portion that extends in a generally perpendicular direction from the third side.

22. The method of claim 18, wherein the first and second opposing shell sides taper toward one another when the fairing is secured about the marine element.

* * * * *